United States Patent [19]

Ito et al.

[11] Patent Number: 4,897,933

[45] Date of Patent: Feb. 6, 1990

[54] TABLEWARE DRYING MACHINE

[75] Inventors: Junya Ito; Akihiko Chiba; Masuo Oku, all of Gunma; Hitoshi Komada, Saitama, all of Japan

[73] Assignee: Sanyo Electric Co., Ltd., Osaka, Japan

[21] Appl. No.: 243,069

[22] Filed: Sep. 9, 1988

[30] Foreign Application Priority Data

Sep. 17, 1987 [JP] Japan ..... 62-232918
May 19, 1988 [JP] Japan ..... 62-122344

[51] Int. Cl.[4] ..... F26B 17/30
[52] U.S. Cl. ..... 34/58; 34/8
[58] Field of Search ..... 34/58, 8, 60, 33, 243 R

[56] References Cited

U.S. PATENT DOCUMENTS 1,717,179 6/1929 Altorfer ..... 34/58
1,755,537 3/1930 Geurosa ..... 34/58
2,784,500 3/1957 Beaumont ..... 34/58

FOREIGN PATENT DOCUMENTS 55-154736 12/1980 Japan ..... 34/58

*Primary Examiner*—Henry A. Bennet
*Assistant Examiner*—John Sollecito
*Attorney, Agent, or Firm*—Darby & Darby

[57] ABSTRACT

A tableware drying machine, comprising a drying tank accommodated in a drying machine housing and a container frame for receiving a tableware container, the frame being connected with a motor means installed in the drying tank and rotated at high speed, and the container containing tableware such as a spoon which has been washed with hot water, wherein the container frame is rotated at high speed to dry the tableware by means of centrifugal force, and a forced air stream is generated such that the container frame and container rotating at high speed function themselves as a centrifugal fan that takes in air through air intake holes provided in an opening-and-closing lid of the drying tank, directs the air towards the center of the drying tank, and discharges the air through outlet openings provided in the upper periphery of the drying tank to make the air entrain moisture in the tank.

9 Claims, 8 Drawing Sheets

TABLEWARE DRYING MACHINE

BACKGROUND OF THE INVENTION

This invention relates to a tableware drying machine to dry tableware which is represented by spoons, knives, forks, and the like, and has been washed.

BACKGROUND OF THE INVENTION

In a conventional business place such as a restaurant where meals are served, a lot of tableware including knives, forks, and spoons is used, and the used tableware is washed with hot water. In general, the tableware thus washed is manually wiped with dishcloths or the like to remove water attached to it. In this case, the dishcloths are not always kept hygienic, it is not desirable to use dishcloths to wipe the tableware for sanitary reasons, and in addition, there is a problem of requiring a lot of time and labor to manually wipe the tableware.

In regard to this, there is a method to let the tableware dry naturally without using dishcloths or the like to wipe it. In this case, since the temperature of the tableware is as high as 80° C. at the time of completion of its washing, waterdrops attached to the tableware evaporate to leave stains called "water spots" on the tableware, and this cause customers unpleasantness when they use such tableware with water spots.

A tableware drying machine has been proposed as shown in Japanese Patent Early Publication No. 61-280840. Instead of manual wiping or natural drying, this machine uses centrifugal force to dry the tableware after its washing. This tableware drying machine comprises a drying tank, a container receiving frame which is connected to a motor means to be rotated at high speed and installed in the drying tank, and a tableware container which has a similar figure to that of the frame and the surrounding walls of which have a lot of small holes for drying. In this machine, drying steps are designed such that tableware is put into the tableware container after it has been washed with hot water, the tableware container is fit in the container receiving frame, the upper opening of the drying tank is closed up tight with an opening-and-closing lid, water attached to the tableware is scattered through the small holes of the tableware container being rotated at high speed, and the tableware dried is collected from the drying tank.

However, since the drying tank of the tableware drying machine described in the publication above is completely isolated from the outside and covered up tight with the lid, the humidity in the drying tank is very high because of water scattered and evaporated from the tableware to which high-temperature waterdrops have been attached at the completion of its washing.

Hence a lot of waterdrops, which are attached to the inside of the opening-and-closing lid, drop on the tableware container just after the completion of its drying and again wet the tableware in the container which has been dried with much effort. Thus this could hardly be said as effective drying. Also there still remains a problem of generating water spots on the tableware, caused by waterdrops reattached to it.

SUMMARY OF THE INVENTION

This invention aims at solving various problems in the prior art mentioned above. It is therefore one object of this invention to provide a tableware drying machine capable of preventing the drying tank from going into a high-humidity state by discharging moisture in the tank, and drying tableware surely in a very short period of time.

For the achievement of this object, this invention is characterized by comprising a drying tank the top of which is to be opened to the air, a drying machine housing for accommodating the drying tank, a tableware container, the surrounding walls of which have a lot of holes for drying, for receiving tableware such as a spoon which has been washed, a container receiving frame for receiving the tableware container to be rotated at high speed in the drying tank, a motor means for rotating the container receiving frame at high speed, an opening-and-closing lid for closing the upper surface opening of the drying tank, air intake openings provided in the opening-and-closing lid for taking air into the drying tank via the center area of the lid by means of the high-speed rotation of the container receiving frame, and outlet openings for discharging the intake of air through the outlet openings.

According to this construction, when the container receiving frame and the tableware container received into the frame are rotated at high speed, the tableware received into the container is dried by scattering water attached to the tableware. The drying tank is prevented from being in the state of high humidity in that the container receiving frame and the tableware container themselves function as a centrifugal fan, air is inhaled to the center of the drying tank via the air intake openings of the opening-and-closing lid, an air stream is forcibly formed by discharging the inhaled air outside through the outlet openings of the drying tank, and this forcible air stream let the moisture in the drying tank go out.

As a result, drying efficiency is greatly improved. The suppression of the high-humidity state in the drying tank prevents lots of dewdrops from adhering to the inside of the opening-and-closing lid so that there is no dropping of dewdrops and the readhesion of waterdrops to the tableware after the completion of drying can be reduced.

Since the generation of such forced air stream to eliminate moisture in the drying tank uses the container and the container receiving frame themselves, the drying machine can be constructed economically by eliminating an exclusive fan for extra air intake and exhaust.

It is desirable to let the opening-and-closing lid cover an area larger than the upper opening of the drying tank and form the air intake openings in the substantially perpendicular side walls provided on the opening-and-closing lid. This minimize dust or rubbish which enters the drying tank through gaps in the peripheries of the opening-and-closing lid and the air intake openings so that the drying tank can be kept sanitary.

It is also desirable to mount a guide means on the inside of the opening-and-closing lid to direct air inhaled to the tableware container. As a result of this, the tableware in the tableware container can be dried more effectively.

Another object of this invention is to provide a tableware drying machine equipped with an automatic locking mechanism which prevents the tableware from coming out of the tableware container rotating at high speed.

For the achievement of this object, it is desirable for this invention to comprise a drying tank the top of which is to be opened to the air, a drying machine housing for accommodating the drying tank, a tableware container, the surrounding walls of which have a lot of holes for drying, for receiving tableware such as a spoon which has been washed, a container receiving frame for receiving the tableware container to be rotated at high speed in the drying tank, a motor means for rotating the container receiving frame at high speed, an opening-and-closing lid for closing the upper surface opening of the drying tank, air intake openings provided in the opening-and-closing lid for taking air into the drying tank via the center area of the lid, outlet openings for discharging the intake of air through the outlet openings, the openings being formed in between the periphery of the upper opening of the drying tank and the outer periphery of the opening-and-closing lid, and a pair of locking bars, which are horizontally pivoted on the upper periphery of the container receiving frame such that first sides of the bars separated by the pivot are heavier than the other sides, and when the container receiving frame is rotating at high speed, the heavy sides of the bars are swung outwards to make the light sides, facing each other, project over the container to be recieved into the receiving frame.

According to this construction, there is no danger lest the tableware should come out of the container receiving frame operating at high speed in that since one side of the locking bars capable of pivoting is heavier than the other side, when the container receiving frame rotates at high speed, the bars rotate horizontally under the influence of centrifugal force, the light sides opposite to the heavy sides project over the inside of the container receiving frame to face each other above the tableware container, and the upward movement of the tableware container is prevented by these bars.

It is desirable to provide an opening for taking the tableware in and out of the tableware container such that a lid which can be opened and shut freely is provided on one side of the container so as not to locate the lid in the upper opening of the container receiving frame. This construction also completely eliminates any danger of allowing the tableware to come out by preventing the lid from opening abruptly during high-speed operations.

A further object of this invention is to provide a tableware drying machine equipped with a safety device which prevents the motor means from operating even if an operating switch is turned on when the switching operation of the door switch which is interlocked by the opening-and-closing movement of the opening-and-closing lid has not been conducted normally.

For the achievement of this object, this invention is characterized by comprising a drying tank the top of which is to be opened to the air, a drying machine housing for accommodating the drying tank, a tableware container, the surrounding walls of which have a lot of holes for drying, for receiving tableware such as a spoon which has been washed, a container receiving frame for receiving the tableware container to be rotated at high speed in the drying tank, a motor means for rotating the container receiving frame at high speed, an opening-and-closing lid for closing the upper surface opening of the drying tank, air intake openings provided in the opening-and-closing for taking air into the drying tank via the center area of the lid, a switching means to be switched in an interlocking way in accordance with the opening-and-closing movement of the opening-and-closing lid, a detecting means for detecting the existence of welded points of contact in the switching means at each time of the opening movement of the lid, and a circuit means for preventing the motor means from operating after the detection of the welded contacts by the detecting means.

DETAILED DESCRIPTION OF THIS INVENTION

Figure 1:
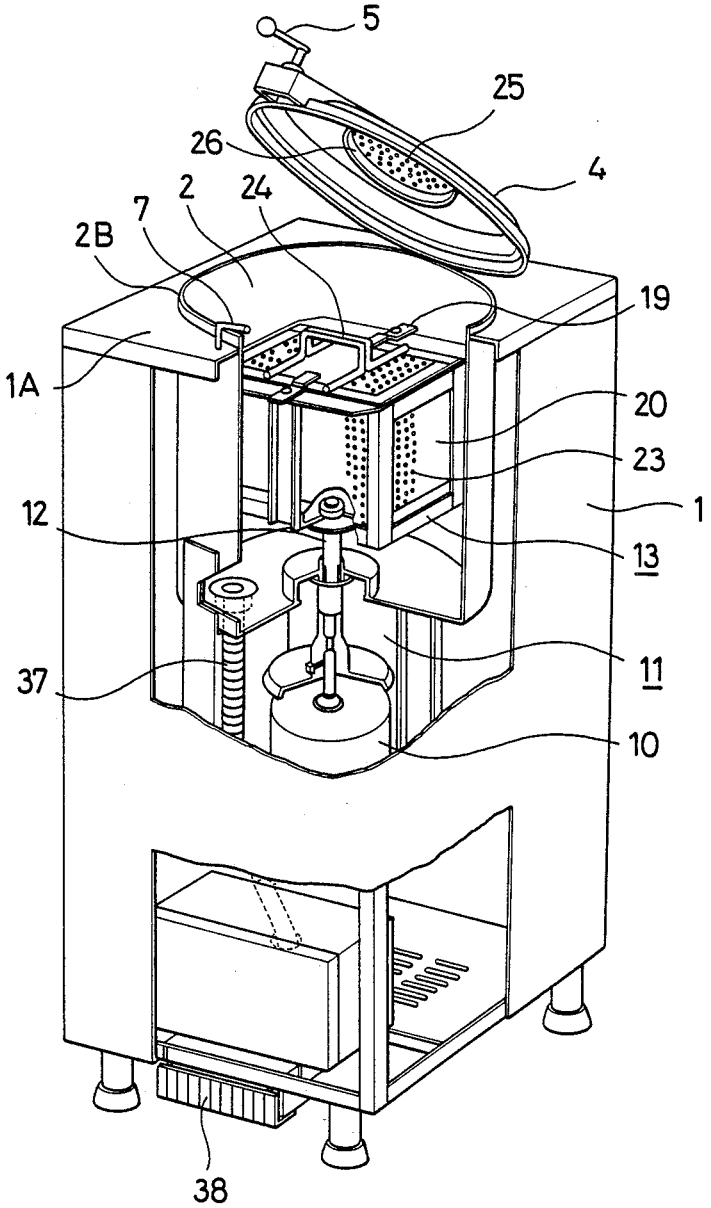
FIG. 1 is an overall perspective view with partial section, showing the inside structure of an embodiment of the tableware drying machine of this invention.
Figure 2:
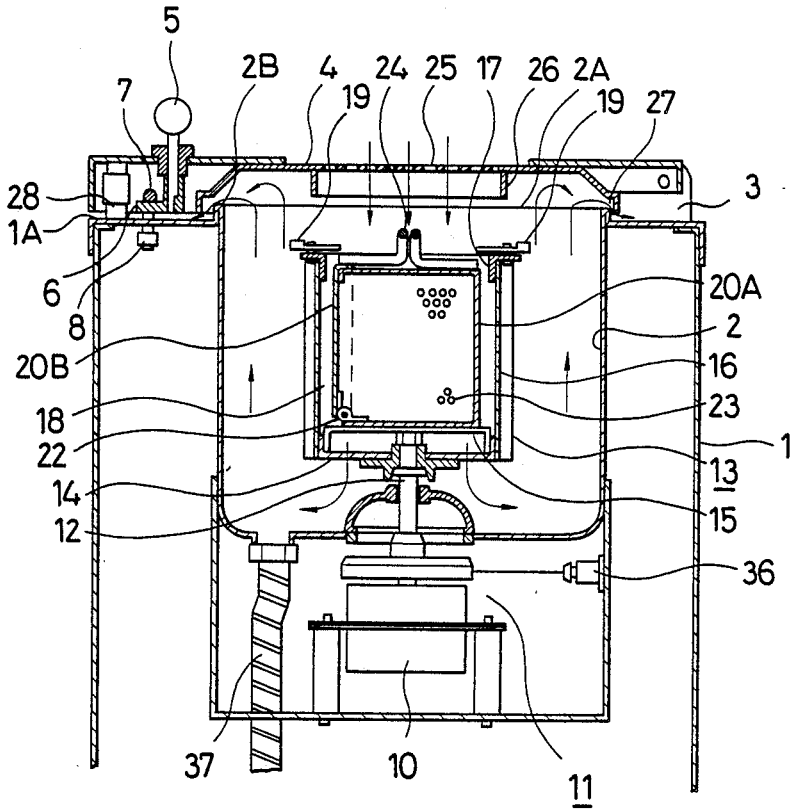
FIG. 2 is a vertical section showing the main parts of the tableware drying machine.
Figure 3:
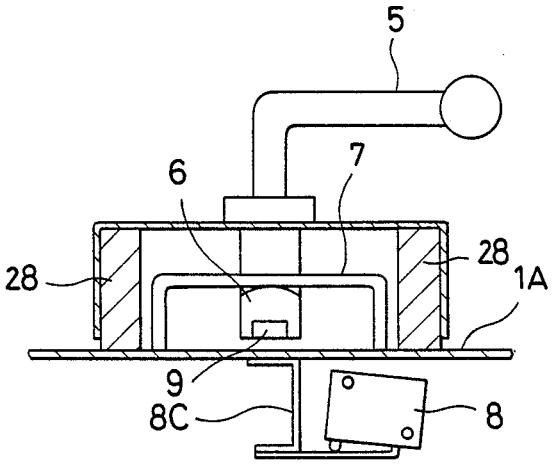
FIG. 3 is an explanatory drawing regarding the opening-and-closing lid in a state of lock and the switching means under operation at that time.
Figure 4:
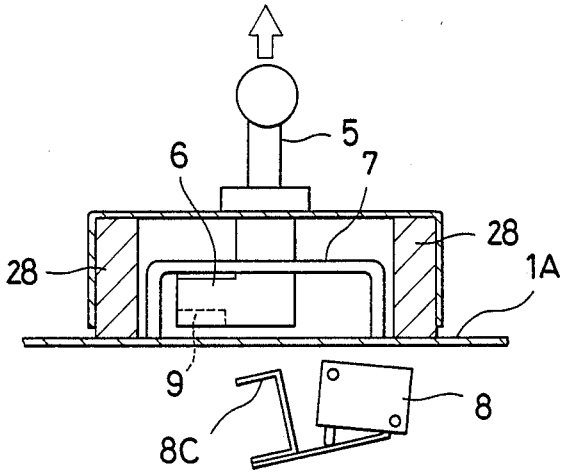
FIG. 4 is an explanatory drawing regarding the opening-and-closing lid in a state of release and the switching means under operation at that time.

An embodiment of this invention will be explained by referring to FIGS. 1–7 as follows: A drying tank 2 with an opening 2A in its upper surface is installed in a drying machine housing 1. The upper surface opening 2A of the drying tank 2 is provided by operating an opening-and-closing lid 4 one end of which is hinged at an axis supporting part 3 on the drying tank housing 1. Since the opening-and-closing lid 4 is always forced in the direction to which the lid is opened under the influence of a spring (not shown) built in the axis supporting part 3, a locking means is provided on the other end of the lid 4 to keep the lid 4 at its closed position. This locking means, as detailed in FIGS. 3 and 4, comprises a locking lever 5 which is placed on the opposite side of the lid to the hinged part, a coupling means 6 which is interlocked by the locking lever 5 to be turned together and the lower part of which is perpendicularly bent, and a coupling lever 7 mounted on the housing means. When the coupling means 6 is coupled with coupling lever 7, a locked state results as shown in FIG. 3, and when the coupling means 6 is decoupled with coupling lever 7, an unlocked state results as shown in FIG. 4. A door switch 8, which is interlocked by the opening-and-closing movement of the opening-and-closing lid 4 to change a point of contact, is mounted on the surface plate 1A of the housing. This door switch 8 is operated in line with the locking and unlocking operations of the locking lever 5 which follows the opening-and-closing movement of the opening-and-closing lid 4. That is, a magnet 9 is incorporated into the coupling means 6 of the locking lever 5, however, when the locking lever 5 is turned in the unlocked direction as shown in FIG. 4, an actuator 8C of the door switch 8 falls by its gravity without the influence of magnetic force exerted by the magnet 9, and the switch is turned to its open contact position 8B as shown in FIG. 7. On the contrary, when the locking lever 5 is turned to cause the locked state, the magnet 9 faces and attracts the actuator 8C by its magnetic force, and the door switch 8 is turned to the closed contact side 8A as shown in FIG. 3.

Figure 5:
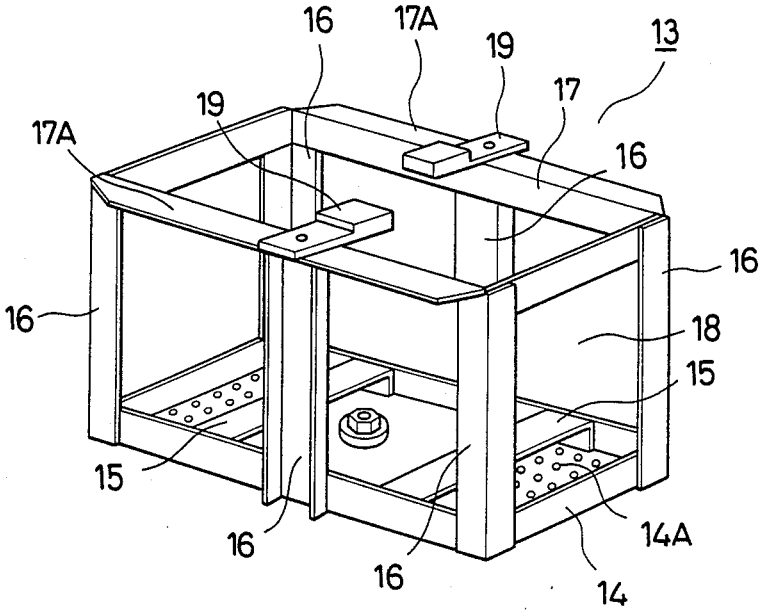
FIG. 5 is a perspective view of the container receiving means to be rotated at high speed after receiving the tableware container.

A motor means 11 comprising a drying motor 10 is installed under the drying tank 2, and the rotating shaft 12 of which motor is projected into the center part of the drying tank 2. The container receiving frame 13 to be rotated at a high speed of 1,600 rpm is connected with the rotating shaft 12. The container receiving frame 13 as shown in FIG. 5, a rectangular in basketlike form as a whole, comprises an oblong bottom plate 14 over which a lot of through-holes 14A are formed, a pair of legged stands 15 fixed on the bottom plate 14, posts 16 erected at each corner of and the center of the long side of the bottom plate 14, and frames 17 to be fixed on the upper ends of the posts 16 to form a rectangular receiving space 18 inside them. Horizontal flanges 17A are formed by bending outwards the upper ends of the long sides of the frames 17, on each center of which franges 17A locking bars 19 are pivoted respectively as shown in FIG. 5 so that the bars can be turned freely around the axis located out of its center. Since one side of it separated by its axis is heavier than the other side, the locking bar 19 is turned under the influence of centrifugal force exerted when the receiving frame 13 rotates so that the heavy sides projecting to the inside of the receiving frame 13 as shown in FIG. 5 are directed to the outside of the receiving frame 13, and consequently as shown in FIG. 2 the light sides, facing each other, project to the insides of the receiving frame 13. Hence the locking bars 19, facing each other, project over the tableware container 20 when it is received into the receiving frame 13 so that the upward movement of the tableware container 20 is prevented.

Figure 6:
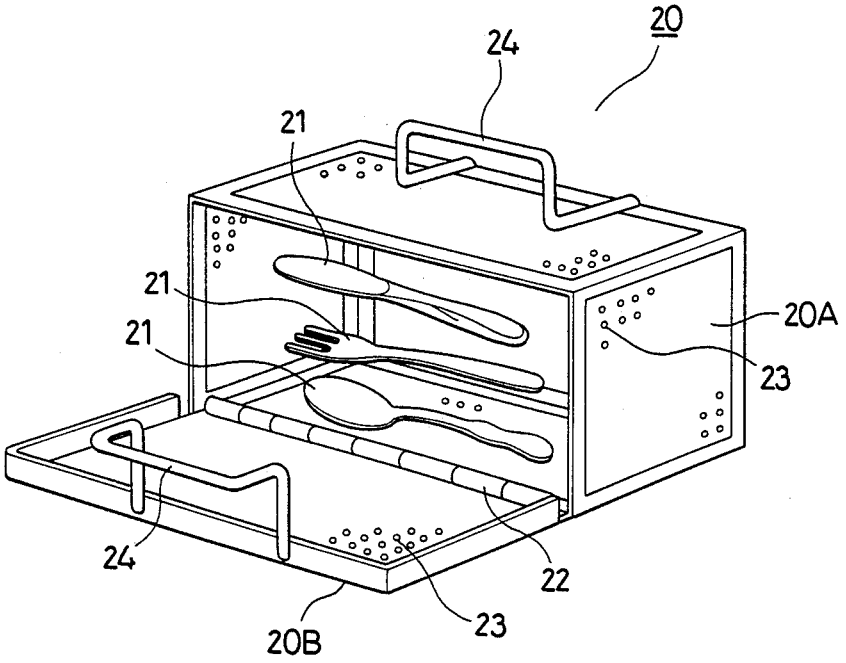
FIG. 6 is a perspective view of the tableware container.
Figure 7:
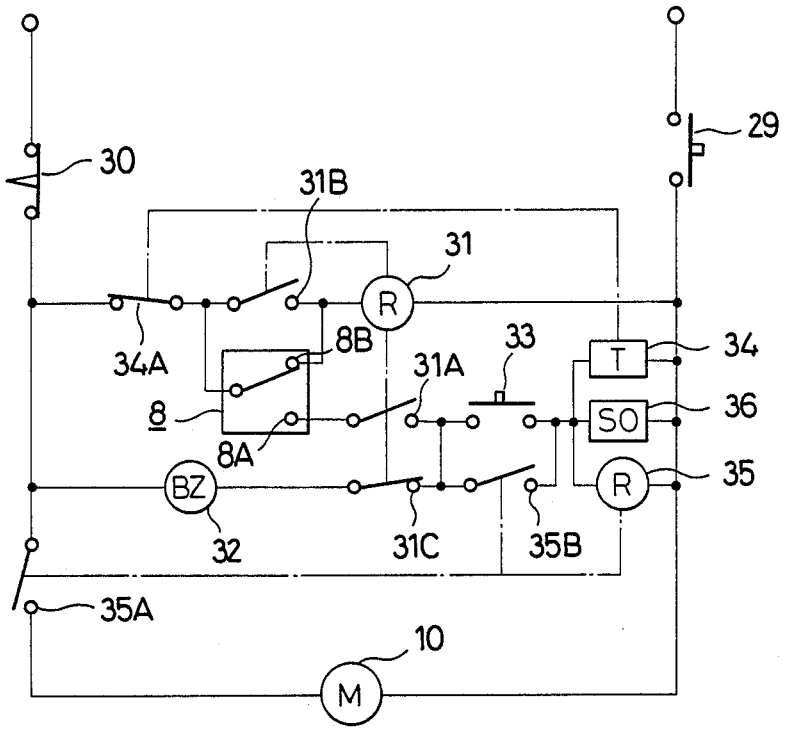
FIG. 7 is an electric circuit diagram of the tableware drying machine of the invention.

In the tableware container 20 which is received into the accommodation space 18 defined by the container receiving frame 13, tableware 21 such as knives, forks, spoons, and the like is laid along the longitudinal direction of the container, as shown in FIG. 6, there is an opening, through which tableware 21 is taken in and out, on one side of the container, and a lid 20B to be opened in a transverse direction, the lower end of which lid is hinged with a hinge 22, is provided. Since it is thus mounted on the side, the lid 20B never open when it is received in the container receiving frame 13, and also the rare possibility that in a case of a container, in which the lid 20B is mounted on the upper side and faces the upper opening of the container receiving frame 13, the lid may open and the tableware in the container may jump out of it when they rotate at high speed, can be avoided. The lid 20B and the container proper 20A are perforated to provide a lot of small holes 23 for drying. Handles 24, which form a pair facing each other above the container 20 when the lid 20B is shut, are fixed on the container proper 20A and the lid 20B respectively.

A lot of air intake openings 25 are formed in an area at the center of the opening-and-closing lid 4 which opens and closes to provide the upper surface opening 2A of the drying tank 2. When the receiving frame 13 and the container 20 rotate at high speed, since they themselves function as a centrifugal fan and cause to form the flow of air in which air is inhaled at around the center of them and discharged through their peripheries, the flow of air is formed such that the outside air is taken in through the air intake openings 25, flows across the inside of the container 20 and along the paths in the drying tank 2 shown by arrows in FIG. 2, and goes out of the drying tank 2. On the inside of the lid 4, a cylinderlike air guide means 26 is mounted so that more of the air which is taken in through the air intake openings 25 is directed to the inside of the container 20. As a result of this, the effect of drying tableware 21 is accelerated by freely passing the outside air over the tableware 21 in the container 20.

When the upper surface opening 2A of the drying tank 2 is closed with the opening-and-closing lid 4, and the lid 4 is locked in such a closed state by the locking lever 5, the opening-and-closing lid 4 forms a gap 27, which functions as an outlet for the air inhaled, between the lid 4 and the periphery 2B of the upper surface opening of the drying tank 2.

Figure 9:
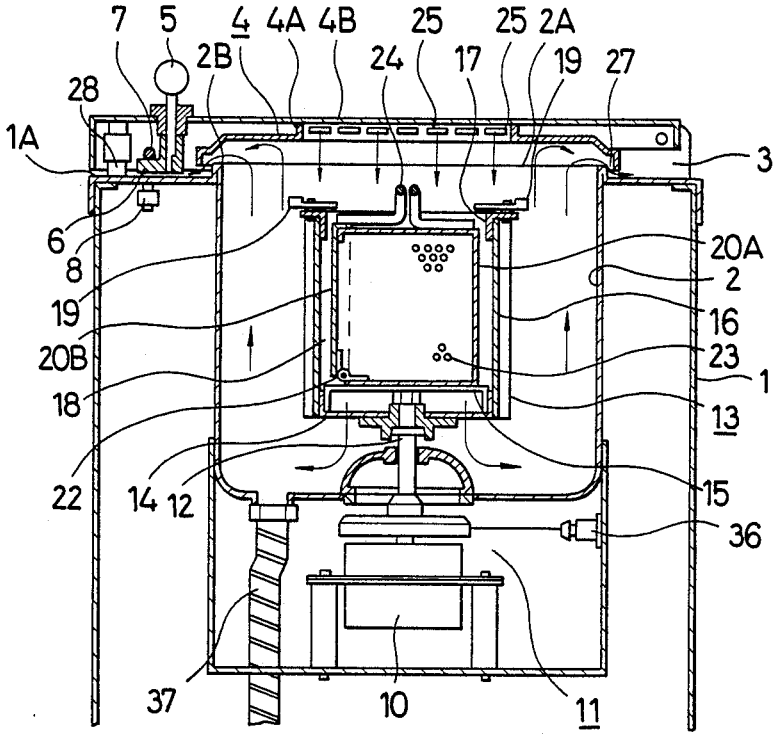
FIG. 9 is a vertical section showing the main parts of the tableware drying machine of FIG. 8.

In this case, since the gap 27 is constructed such that the upper surface opening 2A is covered with the opening-and-closing lid 4, whose size is a little larger than the external shape of the drying tank 2, to place the gap outside the upper surface opening 2A of the drying tank 2 as shown in FIGS. 2 and 9, it becomes difficult for dust or rubbish to enter the drying tank 2 through the gap 27 so that the inside of the drying tank can be kept sanitary. The gap 27 is located in the vicinity of a spring for always pushing the lid 4 in the direction to which the lid opens, and the both side of the locking means. A pair of buffer rubber 28 that is fixed on an area of the inside of the lid 4 located outside the sphere of the upper surface opening 2A of the drying tank 2, is abutted on the upper surface 1A of the housing 1 when the lid 4 is closed to form the gap 27 between the periphery 2B of the upper opening. The rubber 28 functions as a buffer when the lid 4 is closed with great force, and also limits the closed position of the lid with its lower surface being abutted the surface 1A of the housing 1 to prevent the lid 4 from closing up tight the periphery 2B of the opening. Now the safety circuit of the tableware drying machine will be explained by referring to FIG. 7. In FIG. 7, 29 stands for a power switch, 30 stands for an emergency stop switch, and 8 stands for the door switch comprising a closed contact 8A that is contacted when the opening-and-closing lid 4 is closed and in a locked state, and an open contact 8B which is contacted when the lid 4 is to be opened and in an unlocked state.

31 represents a safety relay to be excited via the open contact 8B of the door switch 8, comprising a permanently-open contact 31A connected in series with the closed contact 8A of the door switch 8, a self-maintained contact 31B connected in parallel with the open contact 8B of the door switch 8, and a permanently-closed contact 31C connected in series with a buzzer 32 as an alarm to be described later. 33 represents a self-return type of operating switch, and 34 represents a timer for connecting in series a permanently-closed contact 34A with the safety relay 31. The contact 34A is opened when a certain period of time has elapsed and closed when a current fed to the timer 34 is shut off, to return to the normal position. 35 stands for a motor-control relay comprising a permanently-open contact 35A connected in series with the drying motor 10 and a self-maintained contact 35B connected in parallel with the operating switch 33. 36 stands for a solenoid means for releasing a brake on the drying motor 10, wherein brakes on the drying motor 10 are released when the solenoid means 36 is excited.

A series circuit comprising the buzzer 32 and the permanently-closed contact 31C of the safety relay 31, and a parallel circuit comprising the timer 34, the motor-control relay 35, and the solenoid means 36 are connected in series via the operating switch 33. When impedances of such series and parallel circuits are observed, the buzzer 32 has the maximum impedance in the series circuit, the solenoid means 36 has the minimum impedance in the parallel circuit, and the impedance of the solenoid means 36 is very large as compared to that of the buzzer 32.

When a closed circuit comprising these series and parallel circuits is formed via the operating switch 33, almost all the voltages will be applied to only the buzzer 32 therefor, and the timer 34, the motor-control relay 35, and the solenoid means 36 will not be operated.

Now the operations of this invention will be explained based on the above-described construction. When the power switch 29 is pushed on while the lid 4 is being opened, as the door switch 8 is set at the open contact 8B, the safety relay 31 is excited to close the permanently-open contact 31A and the self-maintained contact 31B, and at the same time open the permanently-closed contact 31C. The tableware 21 which has been washed with boiling water is put into the container 20 by opening the lid 20B, the lid 20B is closed, the container 20 is held by its handles 24 and receives into the receiving space 18 defined by the receiving frame 13, the opening-and-closing lid 4 is closed, and the lid is locked by turning the locking lever 5 in the state shown in FIG. 4 to cause the state shown in FIG. 3 so that the coupling means 6 is fit in the coupling bar 7.

The door switch 8 accordingly is changed so that the open contact 8B is replaced by the closed contact 8A. When the operating switch 33 is pushed on under this condition, a current from a power source is supplied to the timer 34, the motor-control relay 35, and the solenoid means 36 via the timer contact 34A, the closed contact 8A of the door switch 8, and the permanently-open contact 31A of the safety relay 31 so that the timer 34 is started, the brake on the drying motor 10 is released, and the control relay 35 is operated to close its permanently-open contact 35A and self-maintained contact 35B. Even if the operating switch 33 is pushed on, no currents are supplied to the buzzer 32 since the permanently-closed contact 31C of the safety relay 31 is opened. As the control relay 35 is self-maintained via the self-maintained contact 35B even when the operating switch 33 is opened, the drying motor 10 is supplied with currents via the permanently-open contact 35A. The start of this drying motor causes to rotate the container receiving frame 13 and the container 20 which has been received into the frame, at high speed to dry the tableware 21.

That is, waterdrops attached to the tableware 21 are scattered outwards from the small holes 23 for drying by means of centrifugal force generated by the rotation of the container 20, and in addition to this centrifugal dehydration, the flow of air is formed under the influence of a centrifugal fan caused by the rotation of the receiving frame 31 and the container 20 such that the outside air is inhaled through the air intake openings 25 as shown by arrows in FIG. 2, the intake of air is directed to the container 20 by the guide means 26, passed through the container 20, and discharged outside through the gap 27. Such forced stream of air entrains moisture in the drying tank 2 and prevents the humidity in the tank from becoming high so that the efficiency of drying tableware 21 is improved. Since such suppression of the humidity also prevents dewdrops from adhering to the inside of the lid 4, there is no dropping of dew on the tableware 21 which has been dried. Water that is scattered through the small holes 23 of the container 20 all over the walls of the drying machine 2 is collected by a drain pipe 37 extending down from the bottom of the drying tank 2 and a drain dish 38 removably placed at the bottom of the housing 1.

When a prescribed period of time (Preset time is 20 sec since a sufficient drying effect has been proved by experiments under the conditions: 100 pieces of tableware, 50 Hz, 1,500 rpm, and 20 sec) has elapsed from the start of the timer 34, the timer contact 34A is opened and the self-maintained contact of the safety relay 31 is released to open the permanently-open contact 31A and self-maintained contact 31B and close the permanently-closed contact 31C. The self-maintained contact of the control relay 35 is released also to open the permanently-open contact 35A and self-maintained contact 35B. Hence the current fed to the drying motor 10 is shut off to complete a drying operation, and the current fed to the timer 34 is shut off also so that the timer contact 34A returns to the closed state. The excitation of the solenoid means 36 is released also to brake the drying motor 10. After a drying operation has been completed thus, the locking lever 5 in the state shown in FIG. 3 is turned to the state shown in FIG. 4 so that the coupling means 6 is decoupled with the coupling lever 7 and the lid 4 is unlocked. If the door switch 8 is normal at this time, the closed contact 8A is changed to the open contact 8B and the safety relay 31 is excited to close the permanently-contact 31A and self-maintained contact 31B and open the permanently-closed contact 31C. For the restart of drying operations, the container 20 is taken out of the drying tank 2 by opening the lid 4, holding the container by the handles 24, pulling it out of the receiving frame 13, the tableware 21 which has been dried is taken out of the container 20, the tableware 21 which has been washed is put into the container 20 again to be received into the receiving space 18 defined by the receiving frame 13, the opening-and-closing lid 4 is closed and locked, and the operating switch 33 is pushed on.

When the door switch 8 gets out of order, such as welded point of contacts, and the open contact 8B of the door switch 8 is not changed to the closed contact 8A even if the lid 4 is unlocked, the safety relay 31 is not excited so that the permanently-open contact 31A is remained the open state and the permanently-closed contact 31C is remained in the closed state. When the lid 4 is closed and locked, and the operating switch 33 is pushed on in this state, a closed circuit comprising a series circuit that consists of the buzzer 32 and permanently-closed contact 31C of the safety relay 31 and a parallel circuit that consists of the timer 34, the motor-control relay 35, and solenoid means 36 is formed. The timer 34, the control relay 35, and the solenoid means 36 in the parallel circuit will not be operated in such a closed circuit in that almost all the voltages will be applied to the buzzer 32 because of the relationship between the impedances of both circuits as already mentioned above. Hence the buzzer 32 continues going so far as the operating switch 33 is being pressed to inform the failure of the door switch 8.

Figure 8:
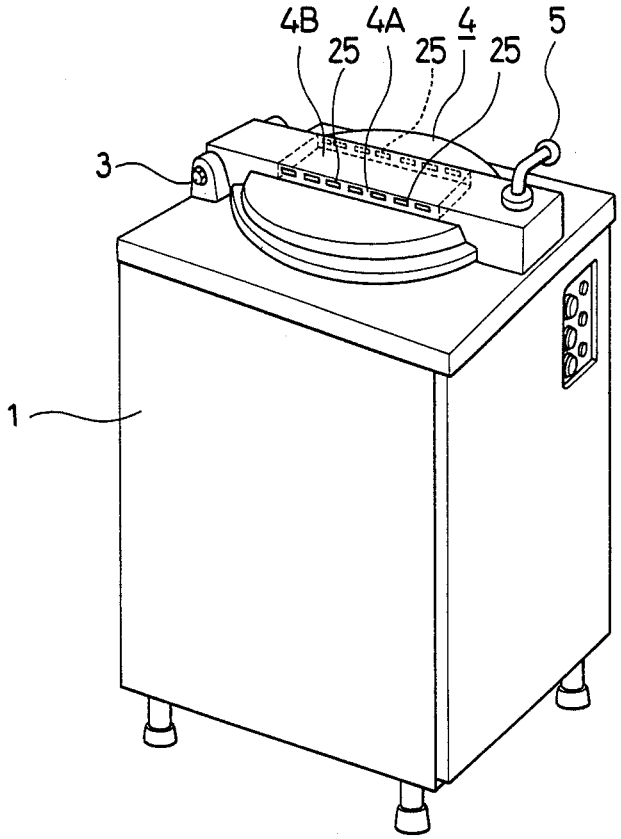
FIG. 8 is an overall perspective view of the tableware drying machine comprising the opening-and-closing lid of another embodiment of this invention.

Another embodiment of this invention will be explained now on the basis of FIGS. 8 and 9 by referring to only features different from the above-mentioned embodiment. Substantially perpendicular side walls 4A are provided on the opening-and-closing lid 4, which covers an area a little larger than the upper surface opening 2A of the drying tank 2, so that they face the container 20 as shown by the rectangular area partly expressed by chain lines on the lid 4 in FIG. 8. The surface of the side walls 4A coincide with the both sides of the fittings 4B holding down the lid 4. A lot of air intake openings 25 through which the inside of the drying tank 2 communicates with the outside are formed in the side walls 4A as shown in FIG. 8.

Although the flow of air in drying operations according to this structure is the same as described above, this embodiment has an excellent effect particularly when it is not operated. Since the air intake openings are formed in the substantially vertical side walls 4A, it is checked as perfectly as possible for dust or rubbish to enter the drying tank 2. As the lid 4 covers an area larger than the upper surface opening 2A of the drying tank 2, dust or rubbish is also prevented from entering the drying tank through the gap 27 functioning as an outlet opening.

What is claimed is:

1. A tableware drying machine, comprising:

a drying tank the top of which is open to the air, a drying machine housing for accommodating the drying tank, a tableware container, the surrounding walls of which have a plurality of holes therethrough for drying, said container being adapted for receiving tableware such as a spoon which has been washed, a container receiving frame for receiving the tableware container, said receiving frame being mounted for rotation about an axis at high speed in the drying tank, said container rotating with said receiving frame when said container is received therein, at least a portion of the surfaces of said frame and container being oriented relative to said rotational axis to induce a flow of air when rotating, motor means for rotating the container receiving frame and said container at said high speed, a lid for opening and closing the drying tank top, air intake openings being provided in the lid for taking air into the drying tank when the lid is closed, said air intake being induced by means of said high speed rotation of the container receiving frame with the container therein, and an outlet opening for discharging said air from said drying machine.

2. A drying machine as claimed in claim 1, wherein the lid includes substantially perpendicular side walls and covers an area larger than the upper open area of the drying tank, and the air intake openings are formed in said substantially perpendicular side walls.

3. A drying machine as claimed in claim 1, wherein a guide means is mounted on the inside surface of the lid, said guide means directing toward the container the intake of air generated by said rotation of the receiving frame and the container.

4. A drying machine as claimed in claim 1, wherein said outlet opening for discharging air is formed between the periphery of said upper opening of the drying tank and the outer periphery of the lid.

5. A tableware drying machine, comprising a drying tank the top of which is open, a drying machine housing for accommodating the drying tank therein, a tableware container, the surrounding walls of which have a plurality of holes for drying, for receiving tableware such as a spoon which has been washed, a container receiving frame for receiving the tableware container to be rotated at high speed in the drying tank, motor means for rotating the container receiving frame at high speed, a lid for opening and closing the top of the drying tank, and a pair of locking bars pivotably mounted on the upper edges of the container receiving frame, when the container receiving frame is rotating at high speed, said bars rotate in a horizontal plane by centrifugation to project over the container received in the receiving frame.

6. A drying machine of claim 5, wherein a gateway opening for getting the tableware in and out the tableware container is provided on the side of the container, and the opening is equipped with a lid to be freely opened and shut.

7. A drying machine as claimed in claim 5, wherein said pair of locking bars include heavier parts on one side of a pivot, said heavier parts being swung outwardly during said high speed rotation, and lighter portions on the other side of said pivot extending over said tableware container received in said container receiving frame during said motion.

8. A tableware drying machine, comprising a drying tank the top of which is open, a drying machine housing for accommodating the drying tank, a tableware container, the surrounding walls of which have a plurality of holes therethrough, for receiving tableware such as a spoon which has been washed, a container receiving frame for receiving the tableware container to be rotated at high speed in the drying tank, motor means for rotating the container receiving frame at high speed, a lid for opening and closing the top of the drying tank, a switching means to be switched in an interlocking way in accordance with the opening-and-closing movement of the lid, a detecting means for detecting the existence of welded points of contact in the switching means at each opening movement of the lid, and circuit means for preventing the motor means from operating after the detection of the welded point of contacts by the detecting means.

9. A drying machine of claim 8, wherein the drying machine comprises an alarm means for informing the existence of the welded contacts in the switching means.

* * * * *